United States Patent [19]

Carrell

[11] 4,336,822

[45] Jun. 29, 1982

[54] WATER LIMER

[76] Inventor: Jessie W. Carrell, P.O. Box 398, Oakman, Ala. 35579

[21] Appl. No.: 149,762

[22] Filed: May 14, 1980

[51] Int. Cl.[3] ..... B65G 69/06

[52] U.S. Cl. ..... 137/268; 422/269; 222/201

[58] Field of Search ..... 137/268, 99; 222/202, 222/203, 199, 200; 422/269, 273

[56] References Cited

U.S. PATENT DOCUMENTS 2,676,733 4/1954 Lober ..... 222/202
2,983,075 5/1961 Mizusawa ..... 137/268 X
3,322,507 5/1967 Smith ..... 422/269 X
3,804,110 4/1974 Madern ..... 137/268

*Primary Examiner*—Alan Cohan
*Attorney, Agent, or Firm*—Holman & Stern

[57] ABSTRACT

A water limer includes a hopper which is periodically impacted to vibrate and loosen the lime and dispense it from an adjustable opening into water flowing beneath the hopper. Periodic impacting is effected by the pretreated water driving a water wheel which periodically rocks a pivot bar. The pivot bar impacts against a dispenser plate which imparts vibrations to the side of the hopper to thereby vibrate and dispense the lime.

5 Claims, 4 Drawing Figures

10
11
12
13
14
15
16
17
18
19
20
21
22
23
24
26
27
35
36
37
38
39
41
42
43
3

WATER LIMER

TECHNICAL FIELD

The present invention relates generally to liming devices and, more specifically, to a device for dispensing lime into water.

BACKGROUND ART

It is known that lime tends to "cake up" into cohesive clumps making it difficult to dispense the lime in continuously-flowing powdered form. This is particularly true in the case of lime dispensed into water wherein the humid environment aggravates the tendency of the lime particles to coagulate. As a consequence, the prior art has recognized a need for jostling or vibrating the container of lime to induce free flow of the lime. Such vibration is commonly achieved in the prior art by means of an electrically actuated motor which imparts vibrations to the lime. This, of course, consumes electrical energy at a time when energy saving is very much desired.

It is an object of the present invention to provide a water liming device which utilizes the energy in the water to be treated to effect vibrations in the lime and thereby facilitate lime dispensing.

SUMMARY OF THE INVENTION

In accordance with the present invention, a water limer includes a hopper having a dispenser plate pivotally mounted along its outside. The dispenser plate includes a catcher portion which extends underneath the adjustable hopper opening to catch the limer and dispense it into the water flowing below. Upstream of the hopper is a water wheel arranged to be driven by the water to be treated. The water wheel periodically rocks a pivot bar which, in turn, forcefully pushes the dispenser plate against the side of the hopper to vibrate the lime therein and assure a free-flowing dispensing action.

BRIEF DESCRIPTION OF THE DRAWINGS

The aforesaid features, objects and advantages will become more readily apparent from a consideration of the following detailed description of the preferred embodiment and from the drawings, wherein.

DESCRIPTION OF THE PREFERRED EMBODIMENT

Figures 1, 2:
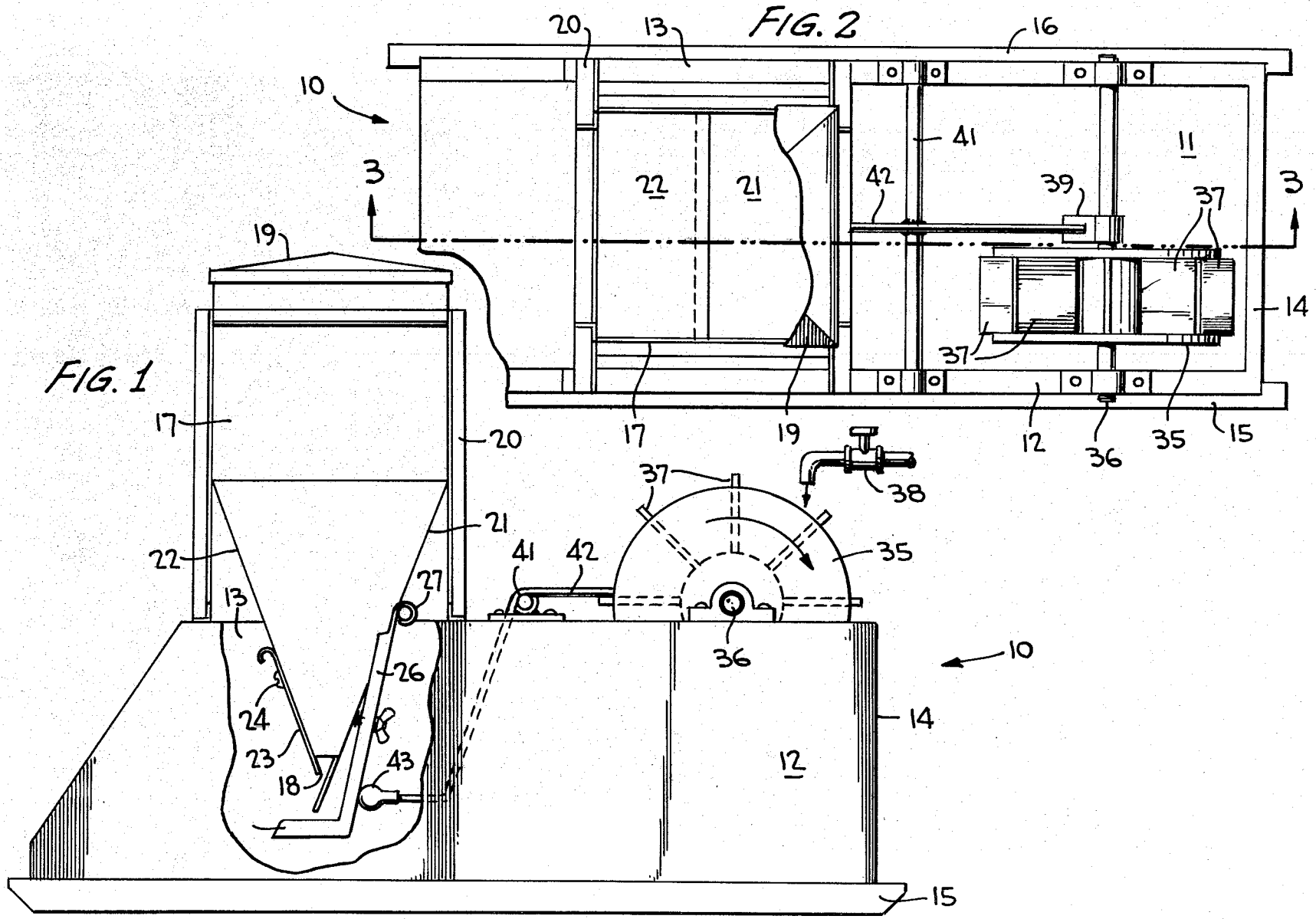
FIG. 1 is a side view in plan, with the side wall partially cut away, of the preferred embodiment of the present invention.
FIG. 2 is a top view in plan of the embodiment of FIG. 1.

Referring to the drawings in greater detail, the water limer according to the present invention includes a mixing chamber generally designated by the reference numeral 10 and including a base 11, side walls 12 and 13, and rear wall 14. The forward end and top of the mixing chamber are open. The chamber 10, and other parts for which materials are not specified herein, are preferably made from rust-resistant metal, such as aluminum, but can be made from cedar lumber properly coated with water proof material. Chamber 10 is secured atop suitable runners 15, 16 extending longitudinally (i.e. in the direction parallel side walls 12, 13) along opposite sides of the bottom of base 11. The runners are preferably made from Creasote or other such material which facilitates sliding the assembly along the ground.

A hopper 17 is supported by a suitable structure 20 from the top edges of side walls 12 and 13 above a location proximate the open forward end of mixing chamber 10. The hopper is supported such that its dispensing opening 18, formed between its downwardly converging front and rear walls, extends well into the mixing chamber 10. A cover 19 is provided for the topple hopper 17.

The rear wall 21 of the hopper extends below and spaced from the hopper front wall 22 to define dispensing opening 18. An adjustable slide plate 23 is secured along the outer surface of front wall 22 by means of an adjustment bolt 24 secured to the front wall 22 to a vertically extending slot 25. By loosening bolt 24 one can adjust the vertical position of plate 23 and thereby vary the size of the outlet opening 18 between the bottom of plate 23 and rear wall 21.

A dispensing plate 26 is pivotally mounted on a rod 27 journaled at the top of side wall 12 and 13 immediately adjacent rear hopper wall 21. Dispensing plate 26 extends down into chamber 10 to below rear wall 21 and includes at its bottom a receiving portion which bends under the dispensing opening 18 in order to receive the lime which drops from that opening. Dispensing plate 26 is secured to rear wall 21 by means of a threaded bolt 29 extending outwardly from rear wall 21 through a suitable opening in dispenser plate 26 where it is engaged by a wing-nut 30. The portion of the bolt 29 subsisting between rear wall 21 and dispensing plate 26 is concentrically surrounded by a compression spring 31 which biases the dispensing plate away from the rear wall of the hopper.

A water wheel 35 is secured to a spindle 36 extending along its axis. Spindle 36 is journaled at the upper edges of side walls 12 and 13 proximate the rear portion of mixing chamber 10. The water wheel 35 includes a plurality of radially extending paddles 37 which define water compartments therebetween. Water to be treated is caused to flow downwardly and into these compartments from a spigot 38 or the like. An actuator tab 39 extends radially from spindle 36 and rotates therewith as the water wheel 35 rotates.

A pivot rod 31 is journaled at the top edges of side walls 12 and 13 at a location between spindle 36 and rod 27. A rocking bar 42 includes three sections demarked by bends therein. A first bend is secured at its underside to pivot rod 41 so that the rod 41 and bar 42 are constrained to pivot together about the axis of rod 41. A first section of rocking bar 42 extends rearwardly from rod 41 to be engaged by actuator tab 39 one time for each revolution of spindle 36. A second portion of rocking bar 42 extends down into mixing chamber 10 wherein it bends again to form a forwardly-extending third section. The forward end of rocking bar 42 (i.e. at the end of the third section) is secured to a generally spherical hammer member 43 which normally rests against dispensing plate 26 approximate the lower end of the plate. Hammer member 43 is sufficiently heavy to provide a rotational moment or torque bias to rocking bar 42, tending to rotate the rocking bar in a clockwise direction as viewed in FIGS. 1, 3 and 4. Dispensing plate 26 serves as a stop against this bias moment which is strong enough to slightly compress spring 31.

Prior to operation, dispensing opening 18 is adjusted by properly positioning slide plate 23 to dispense lime at the desired rate. The spigot 38 is opened to permit water to flow by gravity onto the water wheel 35 at a location rearward of spindle 36. As the water begins to fill a compartment between blades 37, the weight of the water creates a rotational moment about the axis of the wheel, causing the wheel and spindle to rotate clockwise as viewed in FIG. 1. Successive compartments between blades 37 similarly receive water, causing a continuous rotation of the wheel and spindle. The water in each compartment is dumped into the mixing chamber 10 under the force of gravity as the wheel rotates. The thusly dumped water flows below the hopper and out through the open forward end of the chamber 10.

Figure 3:
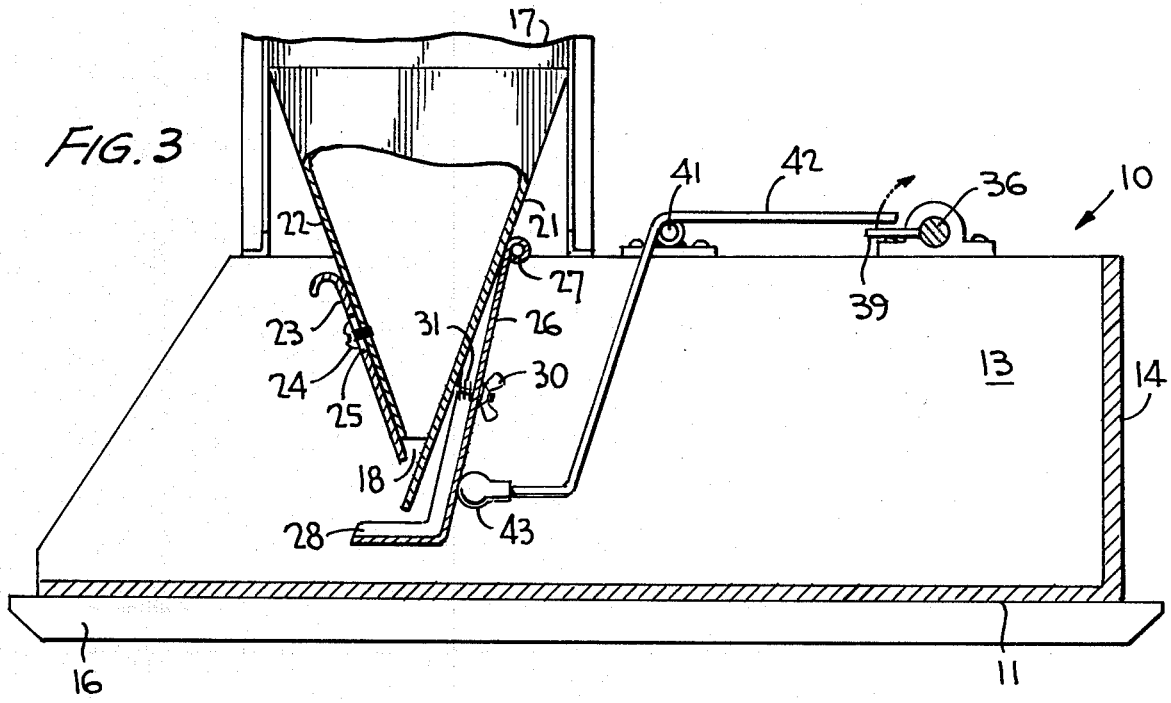
FIG. 3 is a view in section taken along lines 3—3 of FIG. 2.
Figure 4:
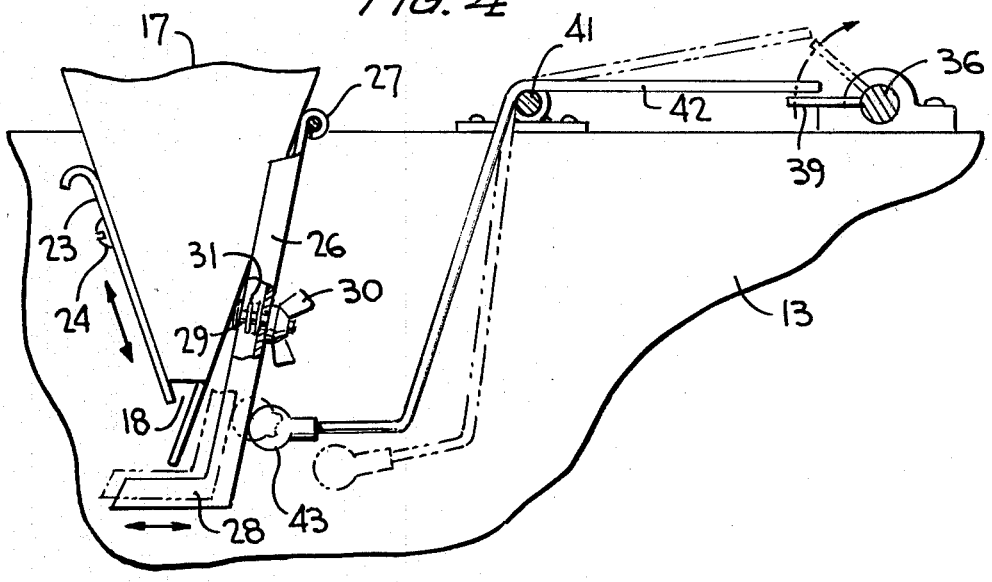
FIG. 4 is a partially diagrammatic plan view showing the details of the dispenser plate and its actuation.

As wheel 35 and spindle 36 rotate, actuator tab 39 actuates rocking bar 42 once for each revolution of the wheel. Specifically, as best illustrated in FIGS. 3 and 4, the clockwise rotation of tab 39 strikes the horizontal section of rocking bar 42 from underneath, causing it to be deflected upwards until the tab clears the rocking bar. This results in an initial counterclockwise displacement of the rocking bar 42 about the axis of rod 41, moving hammer member 43 away from dispensing plate 26. Once the tab 37 clears the rocking bar 42, the weight of hammer member 43 causes the rocking bar to pivot clockwise until the hammer member 43 forceably impacts against the dispensing plate 26. This forceable impact imparts vibrations to the lime within hopper 17, thereby breaking up any clumps of coagulated lime. In addition, the impact produces forward movement of the dispensing plate, particularly at the bottom collector portion 28, thereby tending to shake any lime collected on the collector portion into the water flowing below. The strength of the vibrations and the degree of movement of the dispensing plate are adjustable by tightening or loosening wing-nut 30 to place spring 31 in different degrees of initial compression.

The water flow is adjustable at spigot 38 and should be adjusted in conjunction with screw 24, which controls the size of dispensing opening 18, to dispense the lime in a desired proportion for the particular water flow rate desired.

The wheel 35, rocker bar 42 and dispensing plate 26 are preferably made of lightweight rust-resistant metal.

It should be noted that while only one radially-extending actuator tab 39 has been described on spindle 36, plural such tabs can be provided, if desired, to actuate rocking bar 42 plural times during each revolution of wheel 35.

It should also be noted that, although the invention has been described as a "limer" other chemicals can be likewise dispensed into the water. The important aspect of the invention, regardless of the dispensed chemical, is that the flowing pre-treated water provides the energy which both vibrates and dispenses the material to be dispensed.

While I have described and illustrated various specific embodiments of my invention, it will be clear that variations of the details of the construction which are specifically illustrated and described may be resorted to without departing from the true spirit and scope of the invention as defined in the appended claims.

I claim:

1. Apparatus for dispensing powder-like material into a flowing liquid comprising:

a mixing chamber having side walls, upstream and downstream ends, and an open top;

a hopper containing said powder-like material and having a dispensing opening at its bottom, said hopper being supported above said mixing chamber;

rotatable wheel means disposed in the path of said flowing liquid for directing said flowing liquid into said chamber upstream of said hopper, said wheel means having an axis about which it rotates in response to the flowing liquid; and impact means responsive to rotation of said wheel means for repetitively imparting vibrations to the material in said hopper and dispensing said material into the liquid in said chamber;

wherein said impact means comprises:

a dispensing plate pivotally mounted on said side walls for limited pivotal movement about an axis generally transverse to the liquid flow direction in said chamber, said dispensing plate extending generally along a portion of said hopper; and further means responsive to rotation of said wheel means for periodically impacting said dispensing plate.

2. The apparatus according to claim 1, wherein said further means includes:

rocking bar means pivotally mounted on said side walls for limited pivotal movement about an axis extending transverse to the flow direction in said chamber, said rocking bar means having a first end and a second end;

hammer member means secured to said first end of said rocking bar means and of sufficient weight to pivotally bias said rocking bar means into a position wherein said hammer member abuts said dispensing plates; and actuator means rotatable with said wheel means for periodically displacing said rocking bar means to permit the hammer member to return to its bias position and impact against said dispensing plate.

3. The apparatus according to claims 1 or 2, wherein said dispensing plate includes a receiving portion positioned beneath said dispensing opening to receive material dropped from said hopper, said receiving portions being vibrated when said hammer member impacts said dispensing plate to shake said material into the water flowing in said chamber.

4. The apparatus according to claim 3, further comprising means for adjusting the size of dispensing opening.

5. The apparatus according to claims 1 or 2, wherein said material is lime and wherein said liquid is water.

* * * * *